United States Patent [19]

Bond

[11] 4,398,591

[45] Aug. 16, 1983

[54] HEAT EXCHANGER FRAME COMPONENTS

[75] Inventor: Michael P. Bond, Crawley, England

[73] Assignee: The A.P.V. Company Limited, Crawley, England

[21] Appl. No.: 227,374

[22] Filed: Jan. 22, 1981

[30] Foreign Application Priority Data

Jan. 29, 1980 [GB] United Kingdom ..... 8002979

[51] Int. Cl.[3] ..... F20F 7/00

[52] U.S. Cl. ..... 165/78; 165/166; 165/167

[58] Field of Search ..... 165/78, 162, 166, 167, 165/172, 175, 178

[56] References Cited

U.S. PATENT DOCUMENTS 2,143,157 1/1939 Kotzebue ..... 165/175
4,114,683 9/1978 Verlinden ..... 165/178

FOREIGN PATENT DOCUMENTS 2112472 6/1972 France .
529340 11/1940 United Kingdom .

*Primary Examiner*—William R. Cline
*Assistant Examiner*—John F. McNally
*Attorney, Agent, or Firm*—Christel, Bean & Linihan

[57] ABSTRACT

In a plate heat exchanger of large dimensions the frame members, such as the head and follower, become very heavy and bulky so manufacture and handling becomes matters of difficulty. In accordance with the present invention a head (4) or follower (12) of a plate heat exchanger frame is made-up from separate slabs (5, 6, 7 or 13, 14, 15 respectively). A range of heat exchangers may then have common standard upper and lower slabs and either no intermediate slab or a selected one or more of a range of intermediate slabs.

12 Claims, 15 Drawing Figures

HEAT EXCHANGER FRAME COMPONENTS

This invention relates to plate heat exchangers, and more particularly to frames for plate heat exchangers.

A plate heat exchanger frame normally consists of a fixed head and a fixed end support between which there extend top and bottom bars for support of the plates. The pack of plates is compressed between the head and a follower mounted on the top and bottom bars.

The head and follower are normally fairly massive slabs and as such, particularly with large plate sizes, are expensive to manufacture to the required specification and also difficult to handle during manufacture, transport and installation of heat exchangers. Further, the design of and tooling for the head and follower is an expensive item in the overall cost of design of a heat exchanger.

According to a first aspect of the present invention, there is provided a head or follower for a plate heat exchanger frame, which head or follower consists of two or more separable slabs.

Preferably, the slabs will include an upper slab, a lower slab and one or more intermediate slabs, which may be omitted for frames of comparatively small size.

With some plate heat exchangers, the designs of the plates differ only by the plate length. To accommodate such plates currently requires a different design of frame for each plate length. The segmented head and follower would enable standard upper and lower slabs of both the head and follower to be supplemented by a center section slab or slabs whose length might be made to accommodate the length of the plate. The frame for the shortest plate could be so designed that no center section is required.

According to a second aspect of the invention there is provided a frame for a plate heat exchanger comprising a head and/or follower according to the invention as set forth above.

The invention will be further described with reference to the accompanying drawings, in which.

Figure 2:
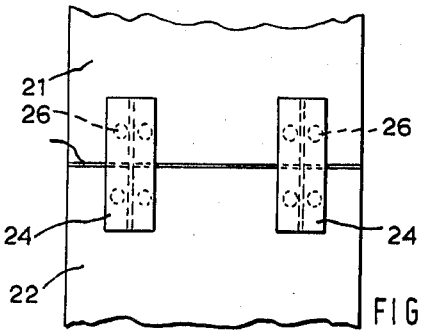
FIG. 2 is a front elevation showing details of one mode of connecting slabs together.
Figure 3:
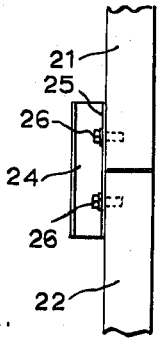
FIG. 3 is a side elevation of the details of FIG. 2.

FIGS. 4 and 5, 6 and 7, 8 and 9, 10 and 11, 12 and 13, and 14 and 15 are views similar to FIGS. 2 and 3 respectively and showing alternative modes of connecting slabs together.

Figure 1:
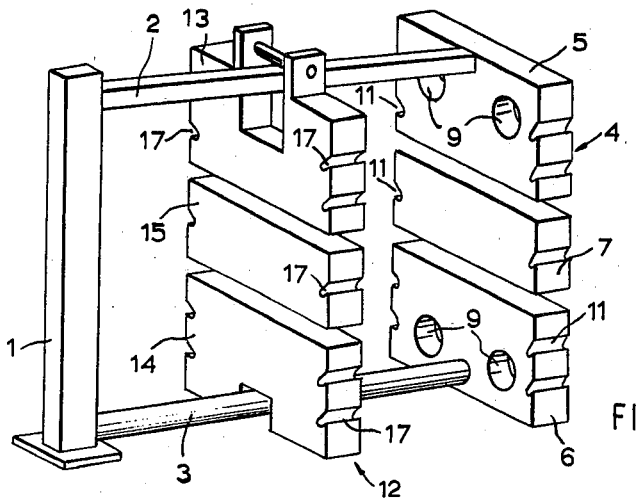
FIG. 1 is a perspective view, partially exploded, of a preferred form of plate heat exchanger frame according to the invention.

FIG. 1 shows a plate heat exchanger frame including a generally conventional end support 1, top bar 2, and bottom rail 3. A head 4 is shown as being divided into three slab-form segments, namely an upper segment 5, a lower segment 6 and a central segment 7. These segments are aligned and secured together by means of any suitable arrangement, details of which are omitted from FIG. 1 and will be described more in detail hereafter. It will be seen that the top and bottom segments 5 and 6 are provided with openings 9 for the conventional feed and discharge ducts, and all the segments are provided with side slots 11 for tie bars as is conventional to maintain compression of the plate pack on large plate heat exchangers.

A follower 12 is mounted, as is conventional, between the top bar 2 and bottom rail 3, and it will be seen that this is also divided into slab-form segments, namely an upper segment 13, a lower segment 14 and a central segment 15 generally similar in shape to the segments 5, 6 and 7, respectively, of the head 4. The segments may also be located and secured together by any suitable means (omitted from FIG. 1), so that the follower may be releasably hung on the top bar. Side slots 17 for tie bars are also provided in alignment with the side slots 11 in the segments of the head 4. Normally, no apertures for the supply and discharge ducts will be provided, but clearly these could be provided if the configuration of the heat exchanger required them.

As explained above, it is envisaged that the upper and lower segments 5 and 6 of the head 4 and segments 13 and 14 of the follower will be common for a range of different sizes of plates, and that the centre section segments 7 and 15 will be chosen to accommodate the differences in sizes, being omitted in respect of the smallest size in the range. The tie bars extending between the corresponding segments of the head 4 and follower 12 will reinforce them, so that the joint between the separate segments of the components need not be particularly strong since it will only have to stand up to the stresses encountered in handling and assembling.

It is envisaged that the invention will provide an improved rationalisation of frame manufacture, and will enable plates of a wide range of lengths to be accommodated by varying only the length, and possibly the number of the centre sections 7 and 15. Also, the component parts of the head and follower would be more easily handled than the complete slab of these parts in the larger sizes of heat exchanger.

FIGS. 2 and 3 show one particular method which may be adopted for securing two slabs, partially shown at 21 and 22, together.

The line of junction between the slabs is shown at 23 and in the mode of securing illustrated, it need not be machined, since no great accuracy is required. The slabs are joined together by short I section beams 24, of which the lower flange 25 is secured to both slabs 21 and 22 by means of bolts 26 engaging in threaded holes in the slabs. It will be envisaged that the beams 24 are attached to the head and follower on the side remote from the pack of plates.

Figure 4:
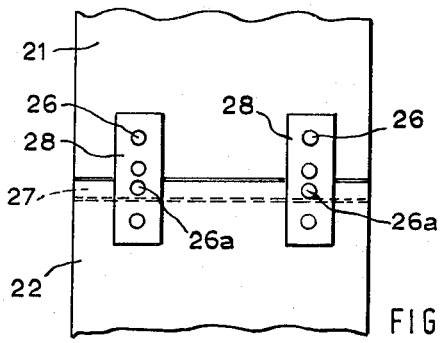
Figure 5:
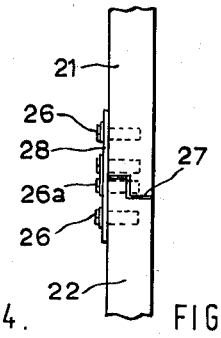

FIGS. 4 and 5 show an alternative in which the slabs 21 and 22 are located together by means of a machined scarf joint 27 and secured together by means of fish plates 28 and bolts 26 received in threaded holes in the slabs. It will be noticed that the bolt **26*a*** in each case passes through both elements of the scarf joint.

Figure 6:
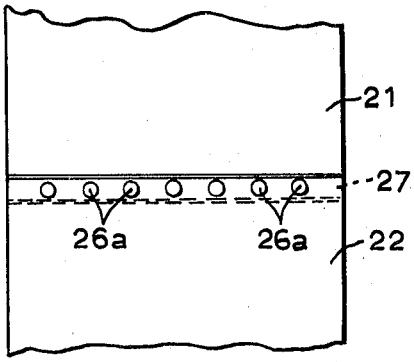
Figure 7:
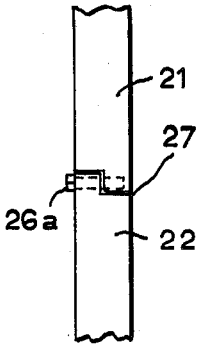

FIGS. 6 and 7 show a further alternative in which the fish plates are omitted and the sole connection between the slabs is provided by the scarf joint 27 ad bolts **26*a*** passing through both elements thereof.

Figure 8:
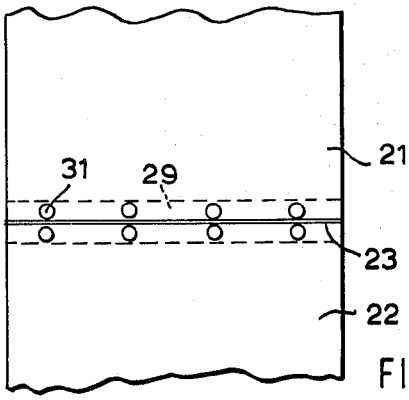
Figure 9:
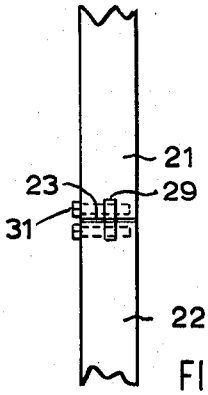

Turning now to FIGS. 8 and 9, it will be seen that the slabs 21 are located together at the junction 23 by means of a bar 29, e.g. of mild steel 1 inch thick, received in machined slots in the faces of the junction 23 and secured by bolts 31 passing through apertures in the bar 29. In this case the junction 23 needs to be machined.

Figure 10:
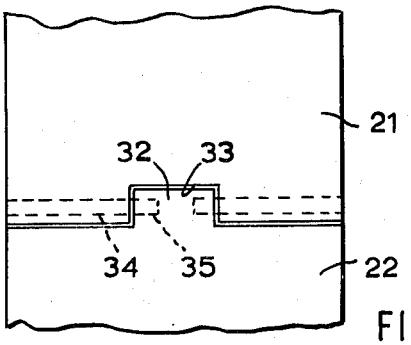
Figure 11:
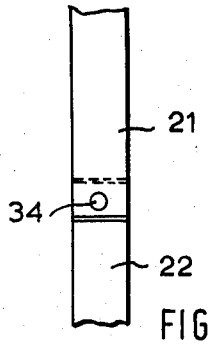

FIGS. 10 and 11 show a further form of attachment by means of the tenon 32 on one of the slabs fitting into a suitable recess or mortice 33 on the other slab, the whole junction being machined, and then secured by long bolts passing laterally into aligned holes 34 ad 35 in the slab 21 and tenon 32 respectively.

Figure 12:
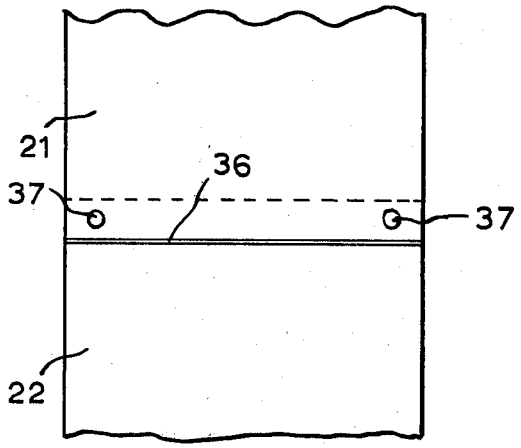
Figure 13:
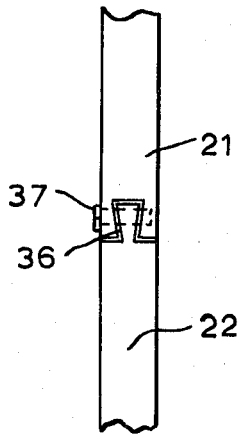

FIGS. 11 and 12 show a dovetail joint 36 secured by means of bolts 37 passing in from the face of the slab 21.

Figure 14:
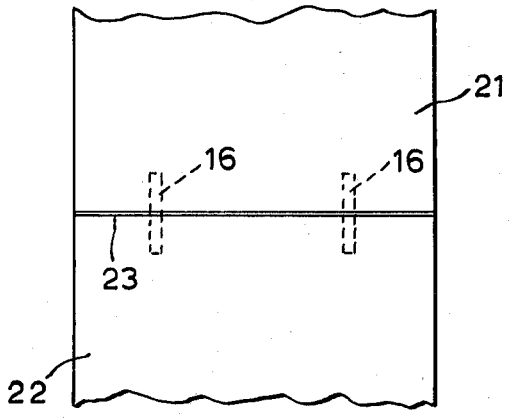
Figure 15:
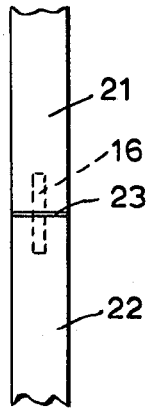

FIGS. 14 and 15 show a machined junction 23 between the slabs 21 and 22 and dowels 16, e.g. formed of round bars, extending into machined holes in both faces of the joint. Such a joint would not normally be used in the follower without some other means of attaching the slabs together.

Various modifications may be made within the scope of the invention.

I claim:

1. A frame element for a plate heat exchanger frame, said frame comprising a head, an end stop, a top rail extending between the end stop and the head, and a follower mounted on the top rail whereby a pack of plates may be suspended on the top rail and compressed between the head and the follower to form the heat exchanger: characterized in that the frame element, selected from the head and follower, consists of two or more separate slab form members having means to connect them.

2. A frame element as claimed in claim 1, in which the separable slab form members include an upper slab form member, a lower slab form member and one or more intermediate slab form members.

3. A frame element as claimed in claim 1, in which two separable slab form members are aligned and secured together by means of dowels.

4. A frame element as claimed in claim 1, in which two separable slab form members are aligned and secured together by means of beams bolted to both slab form members.

5. A frame element as claimed in claim 1, in which two separable slab form members are aligned and secured together by means of an overlapping joint.

6. A frame element as claimed in claim 5, in which the overlapping joint is held together by plates secured to the faces of both slab form members.

7. A frame element as claimed in claim 1, in which two separable slab form members are aligned and secured together by a bar set in machined grooves in both slab form members.

8. A frame element as claimed in claim 1, in which two separable slab form members are aligned and secured together by a tenon joint.

9. A frame element as claimed in claim 1 or 2, in which two slab form members are aligned and secured together by a dovetail joint.

10. A frame for a plate heat exchanger comprising at least one frame element as claimed in claim 1.

11. A frame for a plate heat exchanger comprising a head, an end stop, a top rail extending between the end stop and the head, and a follower mounted on the top rail, whereby a pack of plates may be suspended on the top rail and compressed between the head and the follower to form the heat exchanger, in which at least one of the head and follower is a frame element as claimed in claim 1.

12. A plate heat exchanger having a frame as claimed in claim 11.

* * * * *